United States Patent [19]

Trenary

[11] 3,942,662

[45] Mar. 9, 1976

[54] VEHICLE HAVING FRONT END LOAD SUPPORTING MEMBER

[75] Inventor: Bryant Trenary, Dallas, Tex.

[73] Assignee: Marion Power Shovel Company, Inc., Marion, Ohio

[22] Filed: June 15, 1970

[21] Appl. No.: 46,210

[52] U.S. Cl. ..... 214/140; 214/148

[51] Int. Cl.[2] ..... E02F 3/42

[58] Field of Search ..... 214/148, 140, 765, 771, 214/779

[56] References Cited

UNITED STATES PATENTS

| | | | |
|---|---|---|---|
| 1,021,469 | 3/1912 | Nameche | 294/1 |
| 1,332,227 | 3/1920 | Norman | 214/140 |
| 2,820,555 | 1/1958 | Lessmann | 214/770 |
| 3,024,933 | 3/1962 | Albert | 214/770 |
| 3,155,252 | 11/1964 | Muellner et al. | 214/762 |

*Primary Examiner*—Robert J. Spar
*Assistant Examiner*—Ross Weaver
*Attorney, Agent, or Firm*—Richards, Harris & Medlock

[57] ABSTRACT

A front end loader having a load supporting member, such as a boom, to which is attached an excavating bucket that is to be extended, retracted, elevated and lowered relative to the vehicle. The boom member is attached at one end to a first set of circular gear segments which may be rotated by power means to extend the boom member and thus the bucket attached thereto to impart substantially linear motion to the bucket attached thereto to impart substantially linear motion to the bucket for crowding the bucket into the material to be handled by the loader. A second set of circular gear segments pivotal about the same axis as the first set of gear segments is connected to the boom through lift links which, upon rotation of the second set of gear segments in a clockwise direction and rotation of the first set of gear segments in a counterclockwise direction will assist in extension of the boom relative to the vehicle. The second set of gear segments may be utilized, after full extension of the boom, to lift the boom by reversing the direction of rotation of the second gear segments. The first and second set of the segments may be powered independently to accomplish extension, retraction, lifting and lowering of the boom and the bucket attached thereto to permit crowding of the bucket into the material and lifting or lowering of the bucket from ground elevation to elevations above and below ground elevation. To permit control of the pitch of the bucket, the boom has attached thereto a tilt cylinder which through a linkage may be utilized to tilt the bucket.

7 Claims, 9 Drawing Figures

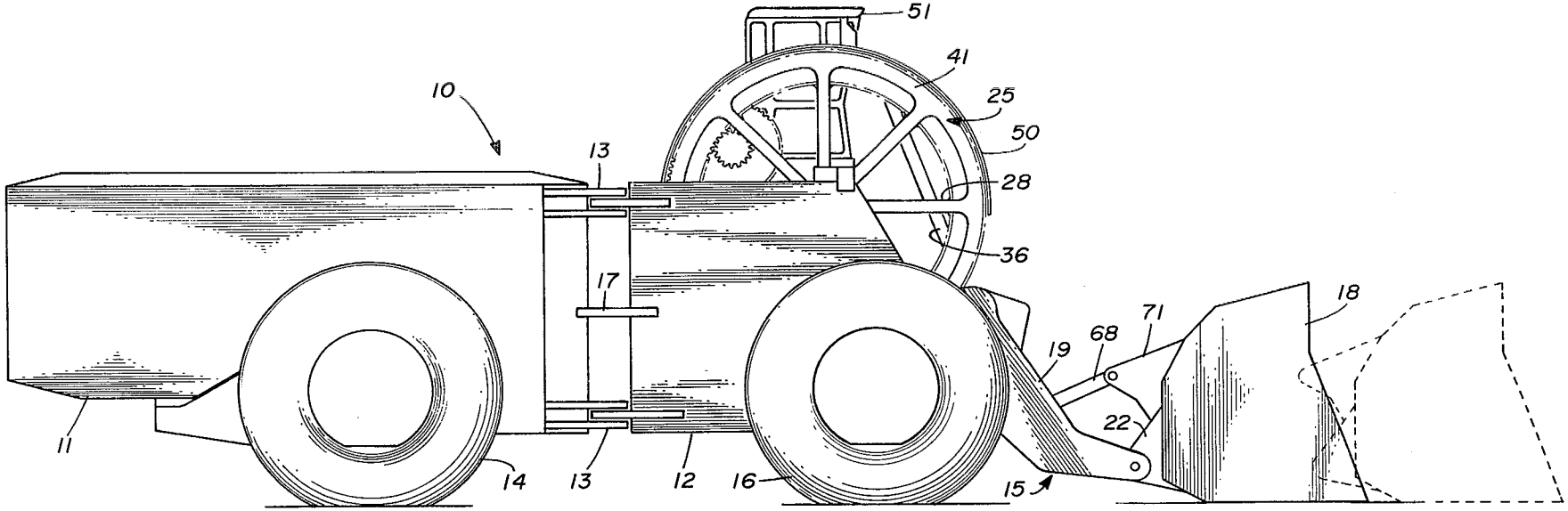
FIG. 1
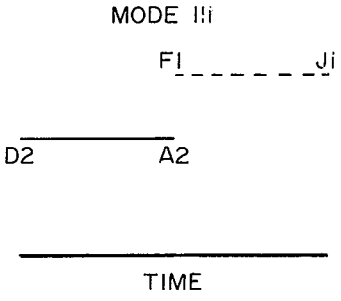
FIG. 6
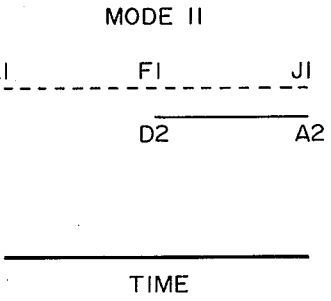
FIG. 7
FIG. 8
INVENTOR:
BRYANT TRENARY
Richards, Harris & Hubbard
ATTORNEYS

INVENTOR:
BRYANT TRENARY

Richards, Harris & Hubbard
ATTORNEYS

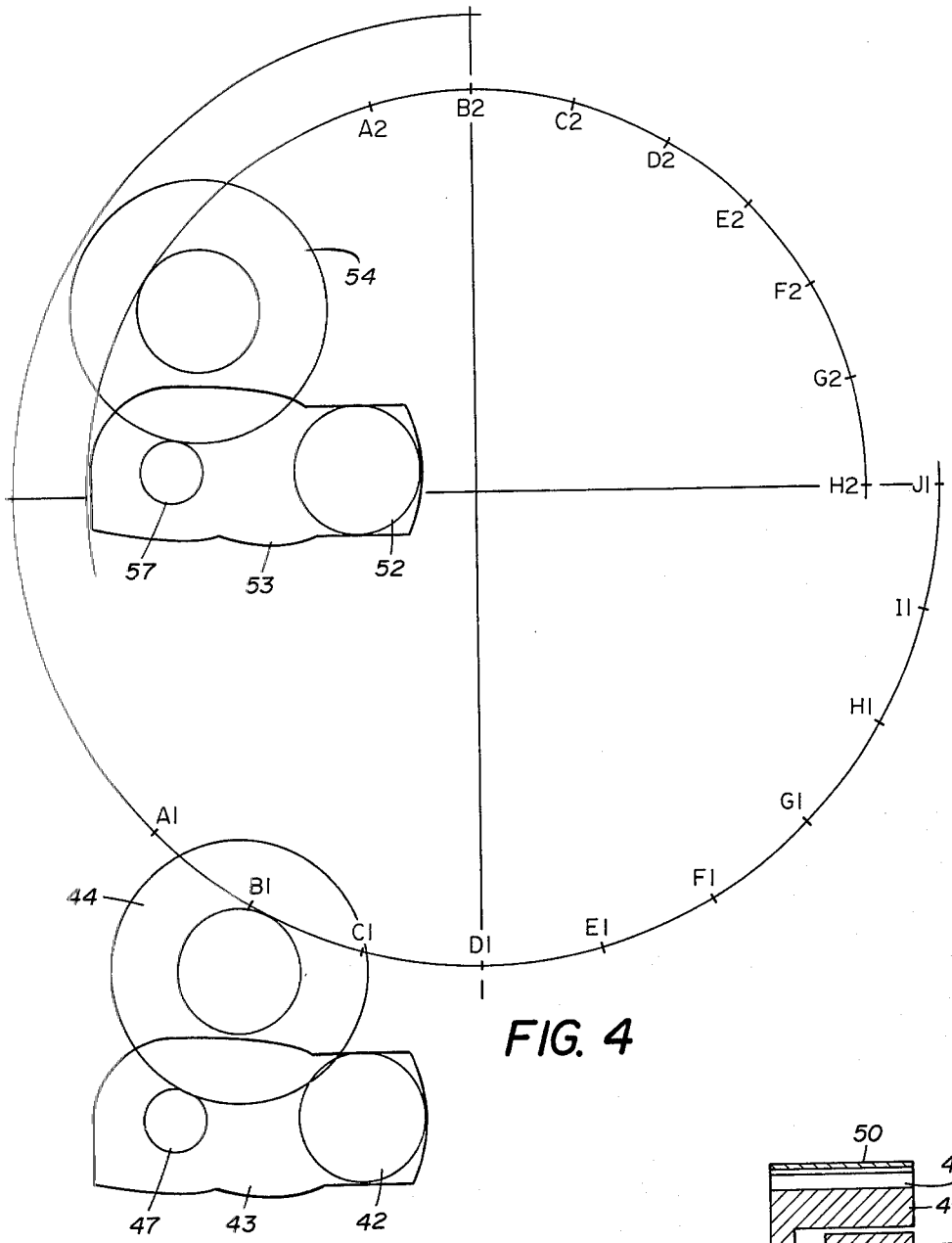
FIG. 4
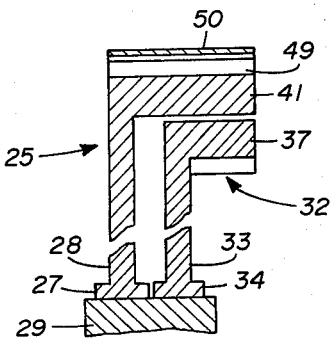
FIG. 9
| MODE | GEAR SEGMENT | POSITION |
|---|---|---|
| I | FIRST | A1-F1 |
| | FIRST | F1-J1 |
| | SECOND | D2-H2 |
| | SECOND | H2-A2 |
| II | FIRST | A1-F1 |
| | SECOND | D2-A2 |
| | FIRST | F1-J1 |
| III | SECOND | D2-A2 |
| | FIRST | F1-J1 |
FIG. 5
INVENTOR:
BRYANT TRENARY
Richards, Harris & Hubbard
ATTORNEYS

VEHICLE HAVING FRONT END LOAD SUPPORTING MEMBER

RELATED APPLICATION

Application for U.S. Ser. No. 46,325, filed on June 15, 1970 now U.S. Pat. No. 3,664,529, under the title APPARATUS FOR MANIPULATING LOAD SUPPORTING MEMBER and assigned to the same assignee.

BACKGROUND OF THE INVENTION

Vehicles which are adapted to support a load from one end thereof are in common usage. Typical of such vehicles are "front end loaders" and "fork lifts" both of which have mechanisms attached thereto for engaging and lifting a load. It has been appreciated with front end loaders, for example, that the front opening excavating bucket is perferably propelled into the material while the tires of the vehicle are stationary. If the tires of the vehicle to which the bucket is attached are moving when the bucket encounters the material there will usually be slippage between the tire and the surface upon which the vehicle is operating causing rapid wear of the tires. Further, if the excavating bucket must be propelled into the material while the vehicle is moving the position of the bucket cannot be as accurately controlled as when the vehicle is stationary and the bucket is propelled by other means. Devices capable of extending the excavating bucket with the vehicle to which it is mounted remaining in a stationary position are illustrated in U.S. Pat. No. 3,327,880 issued to E. C. Brown on June 27, 1967, No. 2,707,059 issued to C. Gerst on Apr. 26, 1955, No. 2,820,555 issued to H. F. Lessmann on June 21, 1958, and Australian Pat. No. 167,063 issued to O. B. Holbrook on Feb. 21, 1956.

The prior mechanisms employed to propel an excavating bucket or the like into a material have, however, had certain disadvantages. They are complex to operate, expensive to maintain or unstable when operating in certain modes.

SUMMARY OF THE INVENTION

The present invention may be generally described as a vehicle having a load supporting member which is to be extended, retracted, elevated and lowered relative to the vehicle which includes the improvement of a boom and means connected to one end of said boom for confining the movement of said end to a circular path. A lift link is also connected at one end to the boom for lifting and lowering of the boom. Means are connected to the other end of the lift link for confining the movement of the other end to a circular path. Power means are provided for moving the said one end of the boom and the said other end of the lift link through circular paths to manipulate the boom.

BRIEF DESCRIPTION OF THE DRAWINGS

In the drawings:

FIG. 1 is a side elevational view of a front end loader which embodies the present invention;

FIG. 4 is a graphic representation of the arcs through which the gear segments of one embodiment are moved;

FIG. 5 is a table containing data relating to modes of movement of the gear segments represented in FIG. 4;

FIGS. 6, 7 and 8 are graphic representations of the relative timing of the movements of the gear segments represented in FIG. 4 during the modes of movement represented in FIG. 5; and FIG 9 is a partial cross-sectional view along line 9—9 of FIG. 3.

DESCRIPTION OF THE PREFERRED EMBODIMENT

Figure 2:
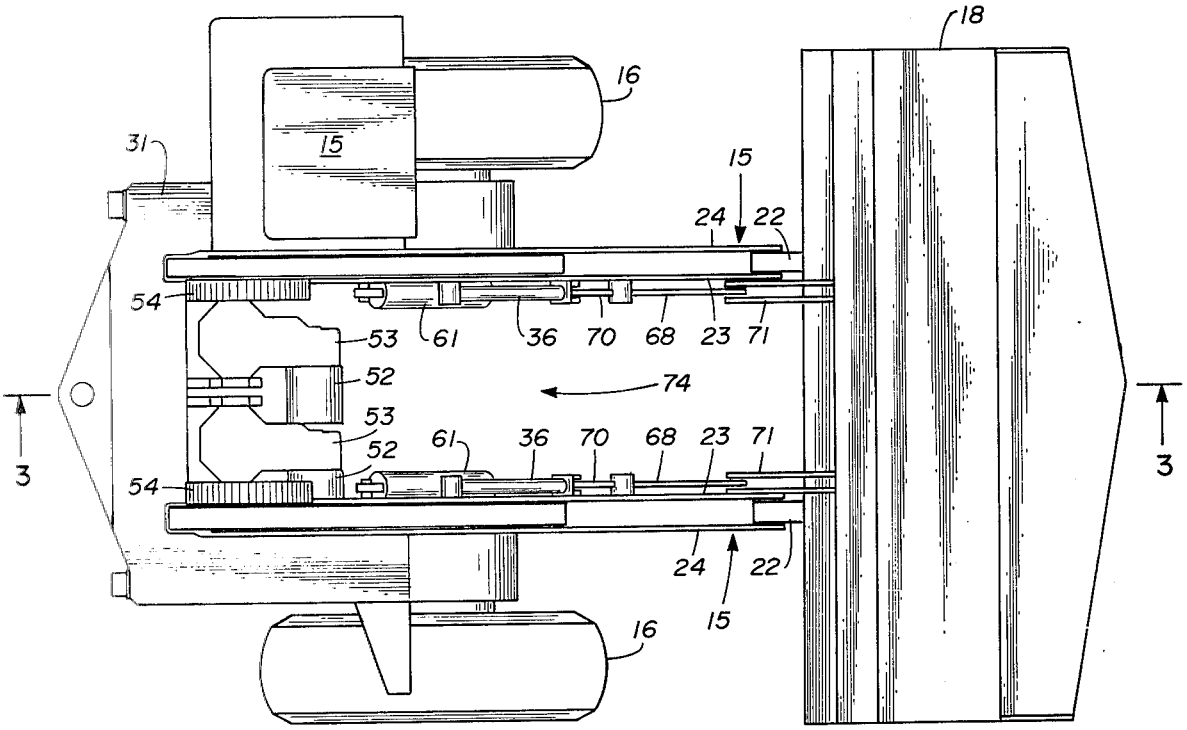
FIG. 2 is a top plan view of the embodiment illustrated in FIG. 1.
Figure 3:
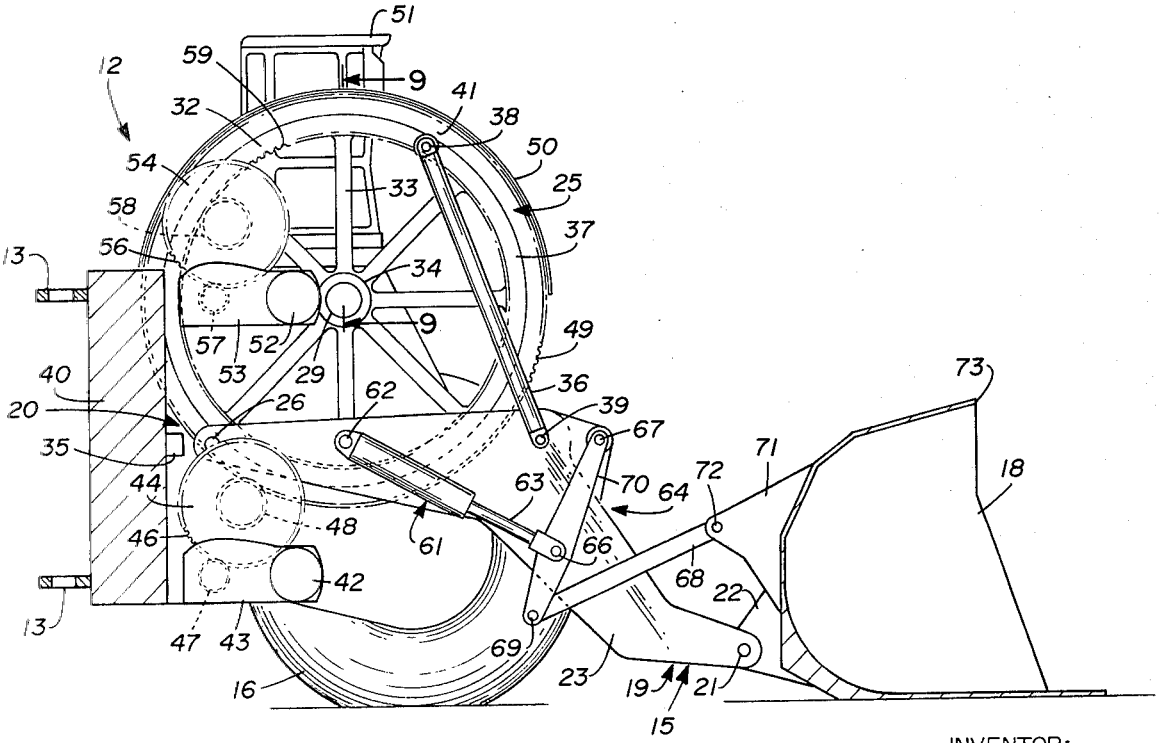
FIG. 3 is a cross-sectional view along line 3—3 of FIG. 2.

With particular reference to FIGS. 1, 2 and 3, there is illustrated an articulated front end loader 10 having a back unit 11 and a front unit 12 which are pivotally joined through wrist pin connectors 13. The back unit 11 is supported for movement upon a pair of wheels 14 which may be, for example, electric wheels which derive their power from an engine and generator system (not shown) housed within unit 11. Similarly, front unit 12 is supported by a pair of wheels 16 which may also be electric wheels which also derive their power from the engine and generator system in unit 11 through conductor 17 which passes between back unit 11 and front unit 12. Extending from unit 12 is a load engaging member, which in the illustrated embodiment takes the form of a front opening excavating bucket 18, which is pivotally connected to a load supporting member such as a pair of booms 19 through bucket pins 21. Each of the booms 19 is formed of parallel plates 23 and 24 so that the ends of each of the booms 19 are furcated. Booms 19 receive ears 22 of bucket 18 within ends 15, to permit pivotal movement of bucket 18 relative thereto as explained above, and at the opposite ends 20 receive therebetween first circular gear segments 25 to which they are pivotally mounted by boom pins 26. Rearward movement of booms 19 is limited by a resilient bumper 35 attached to wall 40 of front unit 11. Arcuate gear segments 25 through hubs 27 to which they are attached by spokes 28, as illustrated in FIG. 9, are mounted for rotational movement about axles 29 supported on the main frame 31 of front unit 12 in any suitable manner.

To assist in extension, retraction, elevation and lowering of booms 19 there are provided second circular gear segments 32 which are provided with spokes 33 which radially extend from the hubs 34 which are rotatably mounted on shafts 29. The second gear segments 32 are connected to booms 19 intermediate the ends of booms 19 by lift links 36 which are pivotally attached to the outer rings 37 of gear segments 32 by lift link pins 38 and to booms 19 by pins 39 which extend through plates 23 and 24 and permit pivotal movement of the lift links 36 relative to booms 19. As the outer rings 37 of gear segments 32 are rotatable about the same axis as the outer rings 41 of gear segments 25, the two sets of gear segments may be used independently or simultaneously to impart movement to booms 19. The outer gear segments 25 may be driven, for example, by electric motors 42 which are connected through gear boxes 43 to gear wheels 44. Gear wheels 44 have outer teeth 46 which engage the output spindles 47 of gear boxes 43 and inner teeth 48 which engage teeth 49 on the outer periphery of rings 41. Teeth 49 are protected by an arcuate guard frame 50 to prevent material being handled from fouling the teeth 49. As electric motors 42 are reversible electric motors, the direction of rotation of which may be controlled by conventional means from the operator cab 51, the direction of rotation of gear segments 25 may be controlled to cause rotation in a clockwise or counterclockwise direction. The inner or second gear segments 32 are powered by electric motors 52 which through gear boxes 53 drive gear wheels 54, the teeth 56 of which engage the output spindles 57 of gear boxes 53. Gear wheels 54 have smaller diameter toothed rings 58 which engage the teeth 59 on the inner periphery of gear segments 32. Electric motors 52, like electric motors 42, are reversible electric motors. They thus permit rotation of the second gear segments 32 in a clockwise or counterclockwise direction.

As the movement of boom 19 will affect the attitude of the excavating bucket 18, means are provided for tilting the bucket 18 and in the illustrated embodiment take the form of hydraulic cylinder and ram assemblies 61 the cylinder portions of which are pivotally mounted on plates 23 by pins 62 and the ram portions 63 of which are pinned to jackknife toggle linkages generally indicated by reference numeral 64. The legs 70 of toggle linkages 64 to which rams 63 are pivotally attached by pins 66 are pivotally attached to plates 23 by pins 67 and pivotally attached at the other end to legs 68 of the linkages 64 by pins 69. Each leg 68 is at the opposite end pivotally attached between one of the furcated ears 71 of bucket 18 by a pin 72. Thus, by extension of rams 63 relative to cylinders 61, the top edge 73 of bucket 18 may be tilted in a clockwise direction. Retraction of the rams 63 into cylinders 61 will affect movement of the top edge 73 in a counterclockwise direction.

For a better understanding of the movements which may be imparted to the boom 19 by inner gear segments 32 and outer gear segments 25, reference is made to FIG. 4 which is a schematic illustration of the arcs through which the outer periphery of gear segments 25 and the inner periphery of gear segments 32 move. When the booms 19 are in a fully retracted position the pins 26, which pin booms 19 to gear segments 25, are at the position generally indicated A1 on the outer arc of FIG. 4. The lift link pin 38 will be generally in the position indicated D2 on the inner arc of FIG. 4. One mode of operation to effect extension of the boom 19 may be referred to as the horizontal crowd mode and is identified in FIGS. 5 and 6 as Mode I. In this mode of operation both the outer gear segments 25 and inner gear segments 32 are utilized to move the booms 19 in a horizontal direction and to elevate booms 19 after full extension of the booms. More particularly, through control means in cab 51, the outer gear segments 25, which are represented by the dotted lines in FIGS. 6, 7 and 8, are moved in a counterclockwise direction from position A1 to position F1. As the outer gear segments 25 pass position B1 the inner gear segments 32, which are represented by the solid lines in FIGS. 6, 7 and 8, are actuated and move from position D2 to position H2 so that the inner gear segments 32 reach position H2 as the outer gear segments 25 reach position F1. At this point the bucket 18 will be at its maximum extended position. Elevation of the bucket 18 by movement of booms 19 in a generally vertical direction is accomplished by continuing movement of outer gear segments 25 from position F1 through position J1 while reversing the direction of movement of the inner segments 32 from a clockwise to a counterclockwise direction so that lift pins 32 are moved from position H2 to position A2 as viewed in FIG. 4.

In a second mode of operation which may be employed which mode may be characterized as the boom crowd mode or Mode II, the outer gear segments 25 are moved from position A1 to position F1 to achieve maximum horizontal extension of bucket 18 while the inner gear segments 32 remain in a stationary position. Elevation of bucket 18 is then achieved as the outer gear segments 25 pass position F1 by moving the inner gear segments 32 in a counterclockwise direction from the initial position D2 so that as the outer gear segments 25 move from position F1 to position J1 the inner gear segments have moved from position D2 to position A2 to effect lifting of the booms 19.

In a third mode of operation which may be employed which may be identified as the lift mode or Mode III, the outer gear segments 25 are positioned at the F1 position and the inner gear segments 32 are actuated to move from D2 to A2. Upon reaching the position A2 the inner gear segments 32 are stopped and the outer gear segments 25 actuated to move from the F1 position to be in a position between A1 and J1, depending upon the amount of lift required. Of course, it will be obvious from the above that various other modes of operation may be employed.

While the illustrated embodiment employs circular gear segments which are pivotal about the same axis, arcuate gear segments which are pivotal about different axes may be employed, though the gear segments should be pivotal in the same plane so that coordinated control may be effected. While the preferred embodiment illustrates an excavating bucket 18 attached to the load supporting member or boom 19, other types of load engaging members such as a fork, a platform, a vertically opening bucket, or the like may be attached to the boom member 19. As a particular load engaging member could be employed which would handle elongated loads which would extend between the sets of gear segments, each of the inner segments 32 is preferably mounted within the periphery of the outer gear segments 25 to provide as much open space in the area generally indicated by the reference numeral 74 as possible thus permitting wider items to be handled. The embodiment illustrated, wherein the inner gear segment is mounted within the outer gear segment, is, however, the preferred embodiment. This preferred embodiment is the invention of Nick Petelski and is claimed in U.S. Pat. No. 3,664,529 issued May 23, 1972. The claims of the present application are to the generic invention of the present invention whereas the claims to the preferred and illustrated embodiment are found in the Petelski patent. The particular arrangement just mentioned, which comprises positioning of the inner segments 32 within the periphery of outer gear segments 25, is the subject of another application for U.S. Ser. No. 46,325, filed by Petelski on June 15, 1970, and assigned to the assignee hereof. The Petelski application is thus directed to an improvement in the generic invention of this application.

After a reading of the above, various other modifications will suggest themselves to those skilled in the art, as the present invention provides the art with means for extending, retracting, elevating and lowering a load supporting member with a structural mechanism having relatively few moving parts and one which has great structural integrity to minimize maintenance and assure positive control over the load supporting member at all times.

What is claimed is:

1. In a vehicle having a load supporting member which is to be extended, retracted, elevated and lowered relative to the vehicle, the improvement which comprises:

a first arcuate gear segment pivotally mounted on said vehicle;

a boom connected to said first gear segment and extending from said vehicle for supporting a load;

a second arcuate gear segment pivotally mounted on said vehicle, independently movable relative to said first gear segment, and positioned in proximity to said first gear segment for movement in a plane parallel to the plane of movement of said first gear segment;

a lift link having one end thereof connected to said second gear segment and the other end connected to said boom to permit vertical movement of said boom by movement of said second gear segment; and means for moving said gear segments relative to said vehicle for manipulating said boom.

2. The improvement of claim 1 wherein the means for moving said first and second gear segments are independently actuatable to permit rotation of one gear segment while the other is stationary, simultaneous rotation of the gear segments in the same direction or movement of one of said gear segments in a clockwise direction and simultaneous movement of the other in the opposite direction.

3. The improvement of claim 2 including:

a load engaging member pivotally attached to the end of the boom which extends from the vehicle; and means for tilting said load engaging member relative to said boom.

4. The improvement of claim 2 wherein said first and second gear segments are pivotal about the same axis.

5. The improvement of claim 4 wherein the movement of said first and second gear segments describe circular arcs.

6. The improvement of claim 1 wherein:

said boom is pivotally mounted to said first gear segment at a point beneath the axis of said segment so that rotation of said first gear segment through a predetermined arc will effect substantially linear movement of said boom.

7. The improvement of claim 6 wherein:

said lift link is pivotally attached to said second gear segment at a point above the axis of the second gear segment so that said second gear segment may be moved in one direction to assist in substantially linear movement of said boom and in the opposite direction to lift said boom.

* * * * *